US012752825B2

(12) United States Patent
Roy et al.

(10) Patent No.: US 12,752,825 B2
(45) Date of Patent: Oct. 6, 2026

(54) TRAIN PREPARATION METHOD AND GATEWAY FOR A TRAIN PREPARATION METHOD

(71) Applicant: Siemens Mobility GmbH, Munich (DE)

(72) Inventors: Constanze Roy, Munich (DE); Falko Hilbig, Reichmannsdorf (DE); Markus Heiny, Fürth (DE); Matthias Oberhofer, Dachau (DE); Florian Worbs, Baiersdorf (DE)

(73) Assignee: Siemens Mobility GmbH, Munich (DE)

( * ) Notice: Subject to any disclaimer, the term of this patent is extended or adjusted under 35 U.S.C. 154(b) by 21 days.

(21) Appl. No.: 18/867,524

(22) PCT Filed: May 10, 2023

(86) PCT No.: PCT/EP2023/062411

§ 371 (c)(1),
(2) Date: Nov. 20, 2024

(87) PCT Pub. No.: WO2023/222476

PCT Pub. Date: Nov. 23, 2023

(65) Prior Publication Data

US 2025/0381993 A1 Dec. 18, 2025

(30) Foreign Application Priority Data

May 20, 2022 (DE) ..... 10 2022 205 064.9

(51) Int. Cl.
*B61L 15/00* (2006.01)
*B61L 27/57* (2022.01)

(52) U.S. Cl.
CPC ..... *B61L 15/0081* (2013.01); *B61L 27/57* (2022.01)

(58) Field of Classification Search
CPC ..... B61L 15/0081; B61L 27/57
(Continued)

(56) References Cited

U.S. PATENT DOCUMENTS 10,435,050 B2 10/2019 Nock et al.
2017/0021847 A1 1/2017 LeFebvre et al.
(Continued)

FOREIGN PATENT DOCUMENTS

DE 102017215225 A1 2/2019
EP 3623202 A1 3/2020
(Continued)

*Primary Examiner* — Yi-Kai Wang
(74) *Attorney, Agent, or Firm* — Laurence A. Greenberg; Werner H. Stemer; Ralph E. Locher

(57) ABSTRACT

A train preparation method includes bringing a stabled, not-yet-operational rail vehicle into an operational state. The train preparation takes place in an active position of at least one current collector of the rail vehicle and the rail vehicle is supplied with electrical energy by an electrical current flowing via the at least one current collector. A gateway monitors at least one status of at least one component of the rail vehicle and generates an error signal if the status deviates from a target status specified for a train preparation and, in the event of the error signal, transmits a message with the gateway-specific mobile-radio-compatible communications interface. A gateway and a rail vehicle are also provided.

16 Claims, 6 Drawing Sheets

(58) Field of Classification Search
USPC ..... 701/19
See application file for complete search history.

(56) References Cited

U.S. PATENT DOCUMENTS

| | | | | |
|---|---|---|---|---|
| 2019/0210623 | A1* | 7/2019 | Aufderheide | B61L 27/40 |
| 2022/0340119 | A1* | 10/2022 | Karunaratne | B60T 17/221 |
| 2023/0071247 | A1* | 3/2023 | Zazzaro | B61L 23/041 |

FOREIGN PATENT DOCUMENTS

| | | | |
|---|---|---|---|
| EP | 3194229 | B1 | 10/2020 |
| EP | 3854624 | A1 | 7/2021 |
| KR | 101041962 | B1 | 6/2011 |

* cited by examiner

TRAIN PREPARATION METHOD AND GATEWAY FOR A TRAIN PREPARATION METHOD

FIELD AND BACKGROUND OF THE INVENTION

The invention relates to a railroad engineering train preparation method in which a stabled and not-yet-operational rail vehicle is brought into an operational state.

Previously known train preparation methods include a large number of preparatory measures that nowadays require manpower-intensive monitoring.

SUMMARY OF THE INVENTION

The invention is based on the object of disclosing a train preparation method that requires less local manpower to be present during the train preparation method than previous train preparation methods.

According to the invention, this object is achieved by a train preparation method with the features recited below. Advantageous embodiments of the train preparation method according to the invention are disclosed in the subclaims.

According to the invention, it is provided that the train preparation takes place when at least one current collector of the rail vehicle is in an active position and the rail vehicle is supplied with electrical energy by an electrical current flowing via the at least one current collector, wherein a gateway monitors at least one status of at least one component of the rail vehicle and generates an error signal if the status deviates from a target status specified for train preparation and, if the error signal is present, transmits a message with a gateway-specific mobile-radio-compatible communication interface.

A substantial advantage of the train preparation method according to the invention consists in the use of the gateway, which automatically monitors the status and, in the event of unexpected status deviations, transmits corresponding messages. For example, an SMS or the like can be sent to operating personnel not present on site if a status problem is identified. The presence of operating personnel during train preparation method can thus be reduced.

It is advantageous if the at least one component or at least one of the components of which the status is monitored is the at least one current collector.

In the latter embodiment of the train preparation method, it is advantageous if the status of the at least one current collector is monitored by its position and the error signal is generated when the current collector is lowered.

Alternatively, it is considered to be advantageous if the status of the at least one current collector is monitored by its actuation state, i.e. the actuation status, and the error signal is generated when the actuation state of the current collector defines a lowering of the current collector. In the latter embodiment, it is advantageously possible to dispense with a separate position sensor for detecting the position of the current collector.

The monitoring of the actuation state of the at least one current collector preferably consists in or preferably at least also includes monitoring the transmission of a lowering control command which causes the at least one current collector to be lowered.

If the gateway detects a lowering control command during train preparation, it preferably generates the error signal and the corresponding message.

The gateway is preferably connected to a data bus on the rail-vehicle side.

The gateway preferably monitors the data traffic on the data bus and status monitoring preferably takes place by evaluating the data traffic on the data bus.

If the error signal is present, the gateway preferably sends out a message via a mobile radio network reporting the presence of the error signal, the current collector lowering and/or a fault in the train preparation.

In other words, the monitoring of the data bus preferably includes monitoring the data bus for the transmission of a lowering control command which causes the at least one current collector to be lowered and, upon detection of the lowering control command, transmitting the message via the mobile radio network that a fault in the train preparation has occurred and/or a lowering control command has been identified.

The message generated by the gateway is preferably sent out as an SMS, a push message or an email via the mobile radio network, either to another mobile radio terminal or a trackside control center, in particular a cloud-based control center.

Alternatively or additionally, it can advantageously be provided that the at least one component or at least one of the components to be monitored in terms of status is an electrical load connected to the current collector. The load is preferably a heating component, a cooling component or an air-conditioning unit.

In particular, in the latter variant, it is considered to be advantageous if the temperature development within the rail vehicle is detected by means of a temperature sensor and a deviation of the status of the component from its target status is inferred if the measured temperature development deviates from a temperature development specified for the train preparation beyond a specified level.

The temperature sensor can advantageously be used to monitor the temperature development within a cargo section of the rail vehicle.

It is considered to be particularly advantageous if the at least one component or at least one of the components to be monitored in terms of status is connected to a data bus on the rail-vehicle side and the status of the component is detected by observing the data traffic on the data bus, in particular by observing control commands transmitted via the data bus or measurement signals transmitted via the data bus or signal levels present on the data bus or process data transmitted via the data bus.

The invention also relates to a gateway. According to the invention, it is provided that the gateway is embodied for connection to a data bus of a rail vehicle and for monitoring the data traffic on the data bus, and the gateway is also embodied to use the data traffic to monitor a status of at least one component of the rail vehicle and, if the status deviates from a target status specified for train preparation, to generate an error signal and, if the error signal is present, to transmit a message with a gateway-specific mobile-radio-compatible communication interface that reports the presence of the error signal and/or a fault in the train preparation and/or the status deviation and/or the status change.

With regard to the advantages of the gateway according to the invention and the advantageous embodiments thereof, reference is made to the above explanations in connection with the train preparation method according to the invention and the advantageous embodiments thereof.

The gateway is preferably embodied to execute the above-described train preparation method.

It is advantageous if the gateway is embodied to monitor control commands transmitted via the data bus, measurement signals transmitted via the data bus and/or signal levels present on the data bus and/or process data transmitted via the data bus.

It is also advantageous if the gateway is also embodied to monitor at least one status of at least one component of the rail vehicle using the control commands transmitted via the data bus, the measurement signals transmitted via the data bus and/or the signal levels present at the data bus and/or the process data and, if the status deviates from a target status specified for train preparation, to generate the error signal.

It is particularly advantageous if the gateway is embodied to monitor the data bus during train preparation for the transmission of a lowering control command that causes the at least one current collector to be lowered and, upon detection of the lowering control command, to transmit the message via a mobile radio network that a fault has occurred in the train preparation and/or a lowering control command has been identified.

The gateway preferably comprises the aforementioned mobile-radio-compatible communication interface, a computing apparatus that can be connected to the data bus and receive data therefrom and a memory in which a software program is stored, which, when executed by the computing apparatus, enables the gateway to operate as described.

The invention also relates to a rail vehicle. According to the invention, it is provided that the rail vehicle is equipped with a gateway as described above.

The gateway is preferably a component that is separate from or independent of a vehicle control unit of the rail vehicle. For example, the gateway can be a retrofit component that has been retrofitted into an existing rail vehicle by connecting it to a data bus on the rail-vehicle side.

The invention is explained in more detail below with reference to exemplary embodiments; here, shown by way of example.

DETAILED DESCRIPTION OF THE INVENTION

For the sake of clarity, the same reference symbols are used in the figures for identical or comparable components.

Figure 1:
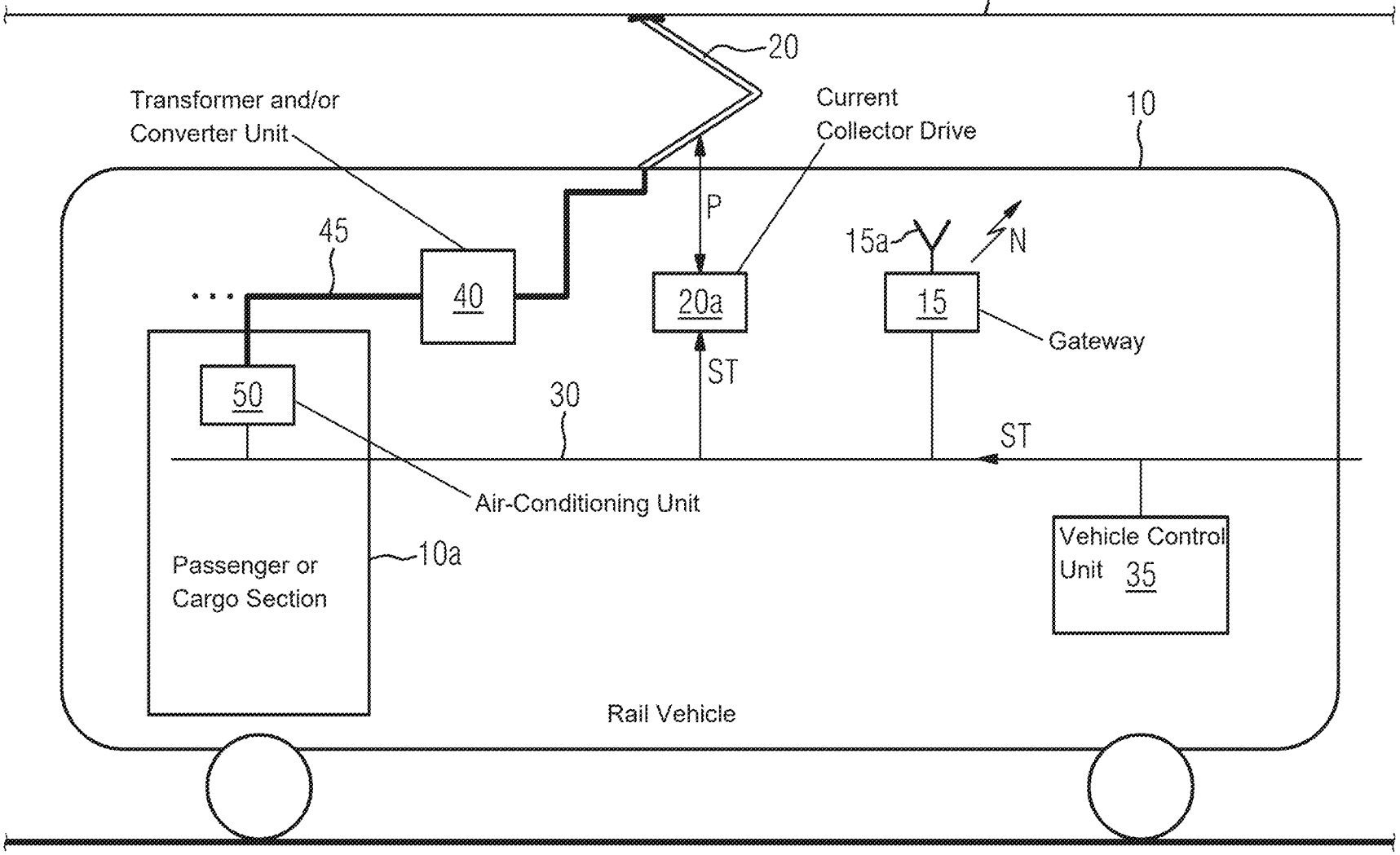
FIG. 1 shows an exemplary embodiment of a rail vehicle according to the invention equipped with an exemplary embodiment of a gateway according to the invention, wherein a current collector of the rail vehicle is connected to a trackside power supply network in raised position.

FIG. 1 shows an exemplary embodiment of a rail vehicle 10 which is equipped with an exemplary embodiment of a gateway according to the invention 15 and is connected to a trackside power supply network 25 via a current collector 20.

A current collector drive 20*a*, which in the exemplary embodiment according to FIG. 1 is connected to a data bus 30, is provided for raising and lowering the current collector 20. The data bus 30 enables a vehicle control unit 35 to control the current collector drive 20*a* by means of control signals ST, thereby triggering lowering or raising of the current collector 20, as indicated by a double arrow P in FIG. 1.

The current collector 20 is connected via a transformer and/or converter unit 40 to a vehicle-side power supply network 45 to which a large number of vehicle-side electrical installations are connected, in particular electrical loads such as, for example, heating units or air-conditioning units, of which only one is shown in FIG. 1 by way of example and is designated by the reference symbol 50. Such electrical loads can, for example, likewise be connected to the vehicle control unit via the data bus 30 and be controlled and/or monitored by the latter.

The aforementioned gateway 15 which is used to monitor the data traffic on the data bus 30 is also connected to the data bus 30. Specifically, the gateway 15 can, inter alia, detect and monitor control commands transmitted via the data bus 30, measurement signals transmitted via the data bus 30 and/or signal levels present on the data bus 30 and/or process data transmitted via the data bus 30.

In the exemplary embodiment according to FIG. 1, the gateway 15 is suitable for ascertaining the status, to be precise the actuation status, of the current collector 20 by reading the information communicated via the data bus 30 to the current collector 20 or to its current collector drive 20*a*, in particular the control signals ST communicated from the vehicle control unit 35 to the current collector drive 20*a*. In other words, by observing the data bus signals or data bus levels, the gateway 15 knows whether the current collector 20 should be in the raised or active position shown in FIG. 1 or in the lowered or inactive position shown in FIG. 2.

The gateway 15 is equipped with a mobile-radio-compatible communication interface 15*a* which enables the gateway 15 to transmit messages, for example messages with which errors and/or the respective position of the current collector 20 are reported.

Figure 2:
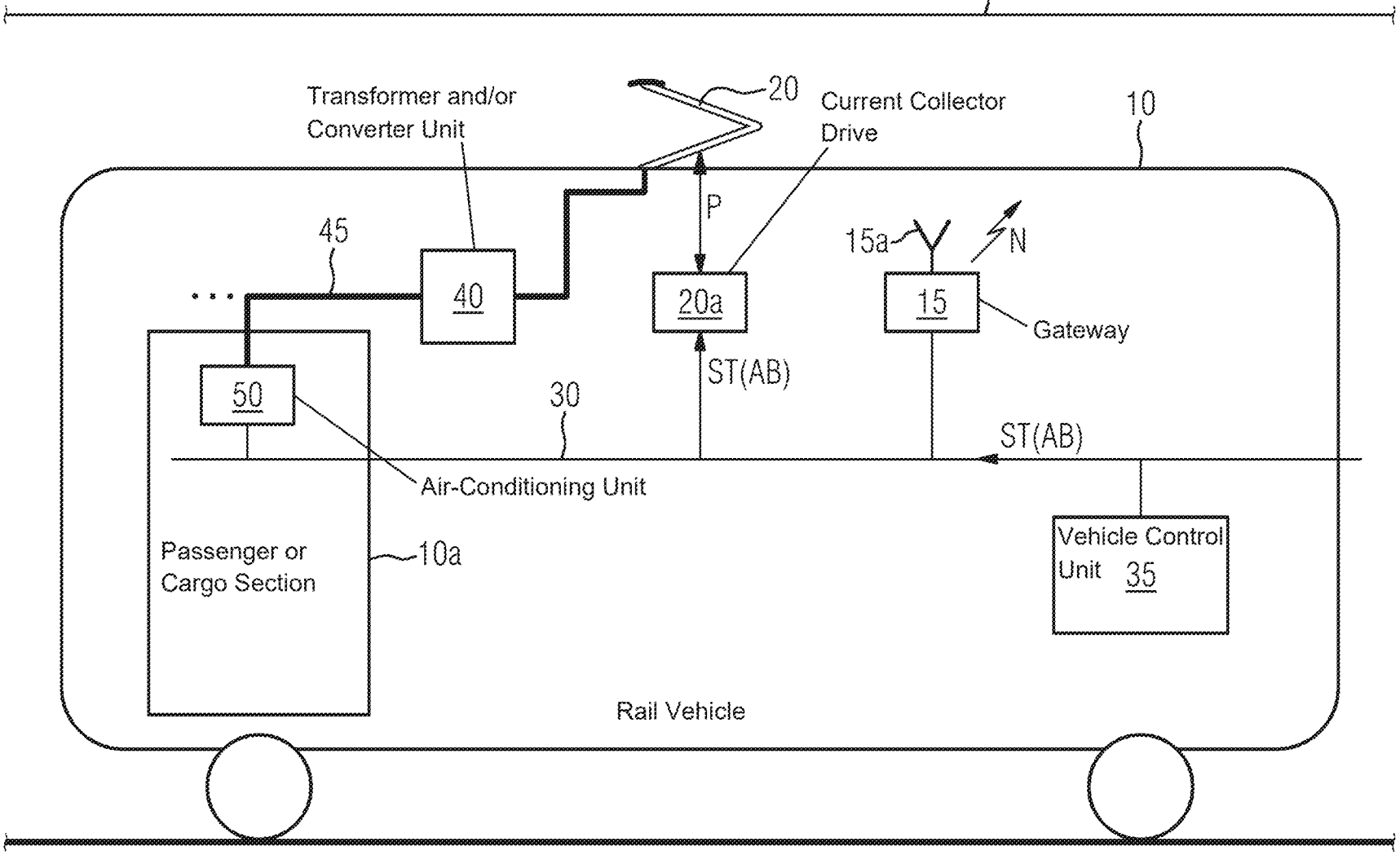
FIG. 2 shows the rail vehicle according to FIG. 1, wherein the current collector is lowered.

In the course of a train preparation method by which the stabled and not-yet-operational rail vehicle 10 as shown by way of example in FIG. 2 is to be brought into its operational state, the rail vehicle 10 according to FIGS. 1 and 2 can, for example, be operated as follows:

If the train preparation method is initiated by the operator feeding a corresponding train preparation command directly or indirectly via the data bus 30 into the vehicle control unit 35, the vehicle control unit 35 communicates an activation command ST(AB) to the current collector drive 20*a* as a control signal ST (see FIG. 2). After receiving the activation command ST(AB), the current collector drive 20*a* raises the current collector 20 and moves it to the raised position shown in FIG. 3.

Before or after this, the start of the train preparation method is preferably reported to the gateway 15, preferably by the vehicle device 35, so that the gateway can start monitoring the data bus 30 with a view to monitoring the position of the current collector 20. Alternatively, the gateway 15 can also infer the train preparation method itself if it identifies the activation command ST(AB) for the current collector drive 20*a* on the data bus 30.

In addition, the vehicle control unit 35 will initiate the other predefined measures provided for the train preparation method.

For example, the train preparation method can provide that certain electrical loads, such as, for example, the air-conditioning unit 50, are activated so that predetermined temperature ranges are achieved in the rail vehicle 10 as a whole or in certain regions, such as, for example, passenger or cargo sections of the rail vehicle 10, by heating or cooling.

Figure 3:
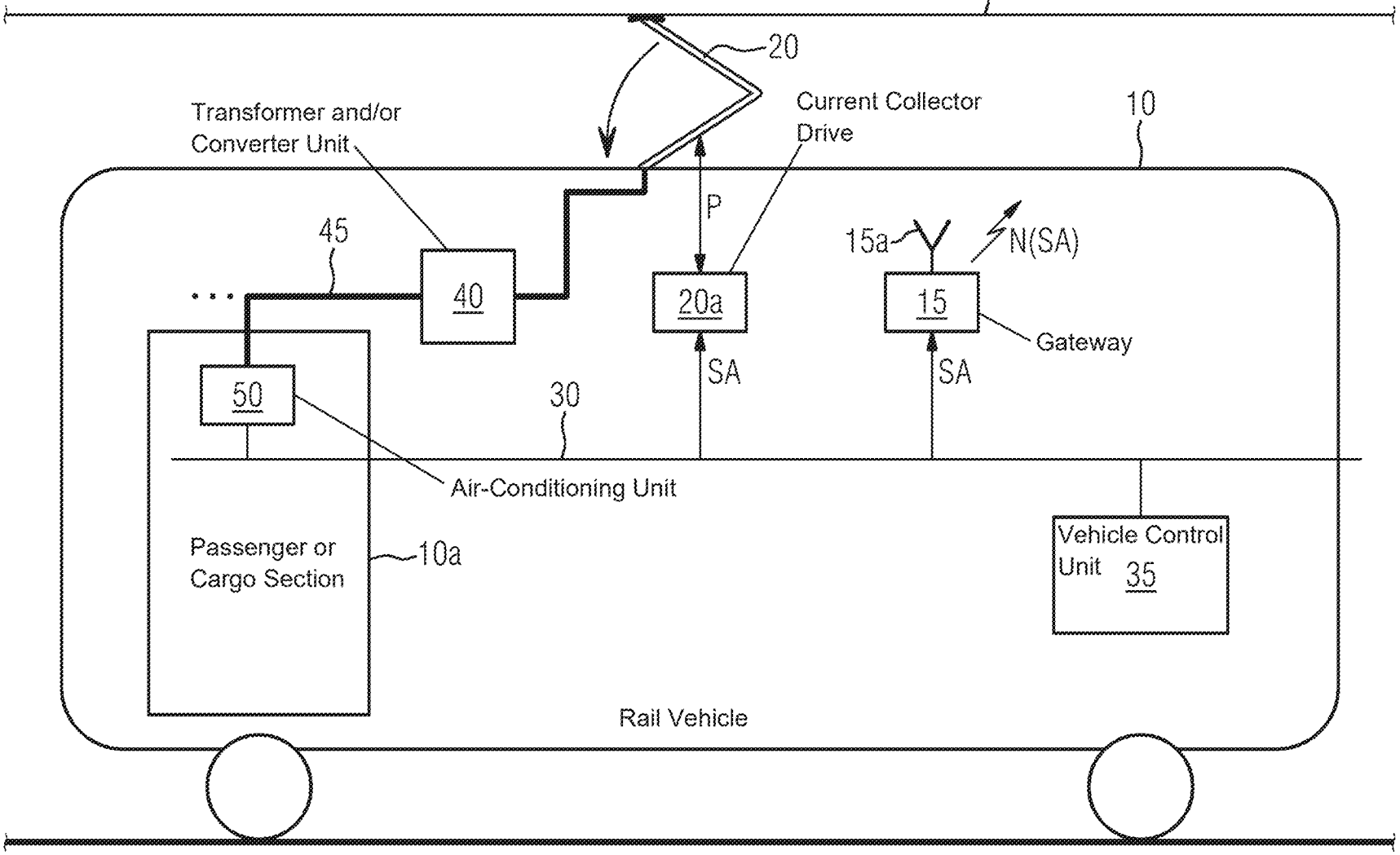
FIG. 3 shows monitoring of a data bus of the rail vehicle by the gateway during a train preparation phase.

The exemplary embodiment according to FIG. 3 shows by way of example that, during the course of the train preparation method, the air-conditioning unit 50 is activated to control the temperature of a passenger or cargo section 10*a* of the rail vehicle 10.

If the gateway 15 establishes during the train preparation method in the course of its monitoring of the data traffic on the data bus 30 that a lowering control command SA which causes the at least one current collector 20 to be lowered is unexpectedly transmitted via the data bus 30 (see FIG. 3), it infers an error and generates an error signal and a message N, which it sends out via its gateway-specific communication interface 15*a*. The message N can indicate that the lowering control command SA has been identified and/or a fault has occurred in the train preparation. In the latter variant, the gateway 15 therefore already interprets the fact that the lowering control command SA is present.

The lowering control command SA can have been generated as a control signal by the vehicle control unit 35 or, in the event of an error, by another component of the rail vehicle 10, but this is not relevant here for the mode of operation of the gateway 15 with regard to the generation of the error signal and the message N.

Figure 4:
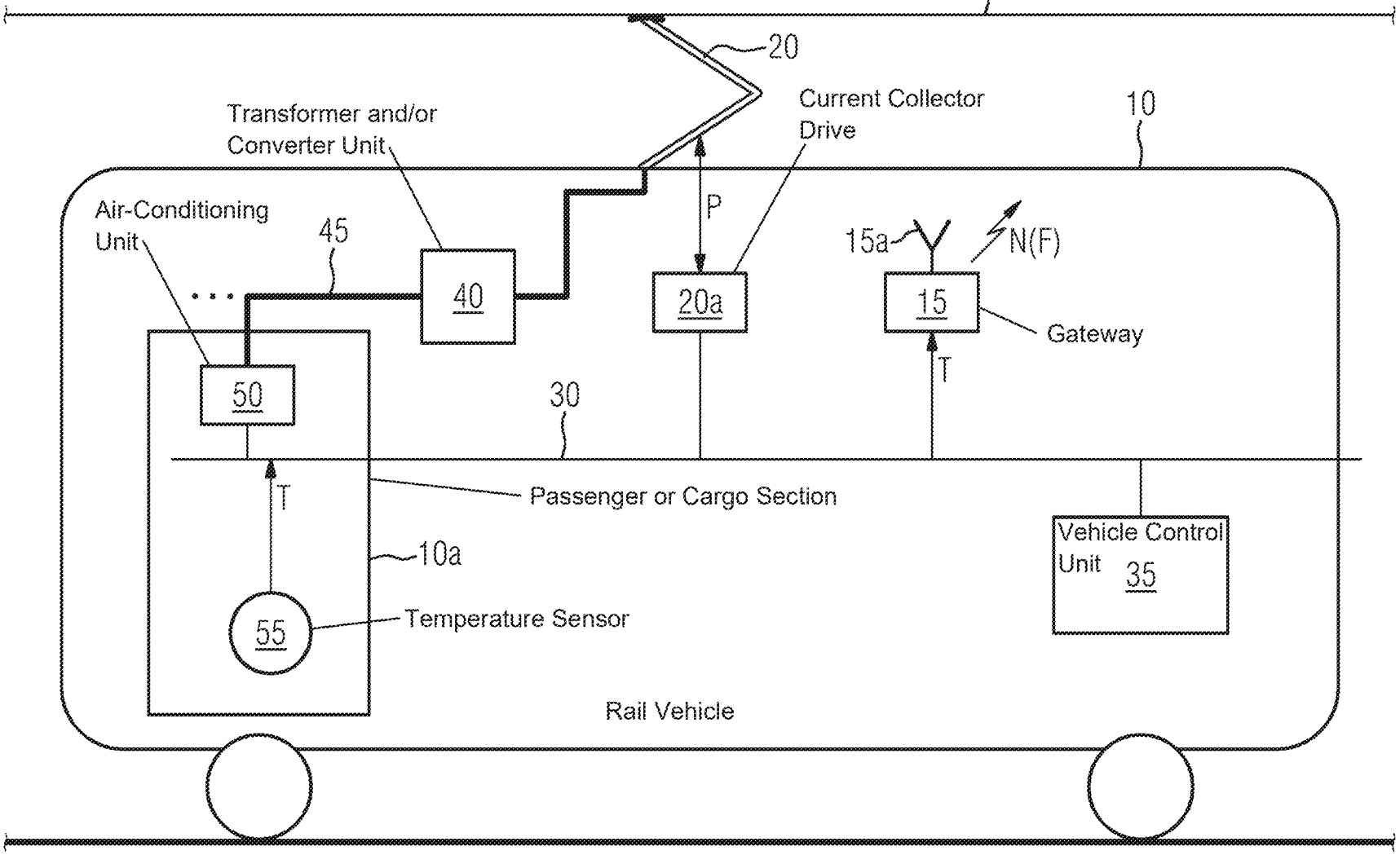
FIG. 4 shows a further exemplary embodiment of a rail vehicle according to the invention in which a sensor is additionally connected to a data bus and the gateway monitors the status of an electrical load of the rail vehicle by monitoring the sensor signal from the sensor.

FIG. 4 shows a further exemplary embodiment of a rail vehicle 10 equipped with an exemplary embodiment of a gateway according to the invention 15.

In the exemplary embodiment according to FIG. 4, a temperature sensor 55 is additionally connected to the data bus 30 and monitors the temperature in the passenger or cargo section 10*a* that is controlled by the air-conditioning unit 50 and feeds a corresponding temperature signal T into the data bus 30; since the gateway 15 is connected to the data bus 30, it is also able to receive and evaluate this temperature signal T.

The gateway 15 is thus able to detect the temperature development within the rail vehicle 10 by means of the temperature sensor 55. If the gateway 15 is configured accordingly, it is also advantageously able to infer a deviation of the status of the air-conditioning unit 50 from its target status, for example if, during the train preparation method, the measured temperature development in the passenger or cargo section 10*a* controlled by the air-conditioning unit 50 deviates from a temperature development specified for the train preparation beyond a specified level.

If, for example, it is provided in the course of the train preparation that the passenger or cargo section 10*a* is to be heated with the air-conditioning unit 50 and the expected heating does not occur, an error in the operating status of the air-conditioning unit 50 is inferred and an error signal F is generated and a corresponding message N is sent.

If, for example, it is provided in the course of the train preparation that the passenger or cargo section 10*a* is to be cooled with the air-conditioning unit 50 and the expected cooling does not occur, an error in the operating status of the air-conditioning unit 50 is likewise inferred and an error signal F is generated and a corresponding message N is sent.

A suitable configuration of the gateway 15 can be achieved in a simple manner by programming the operating software of the gateway 15, as explained below in connection with FIG. 6 and the operating software program SPM shown there.

Figure 5:
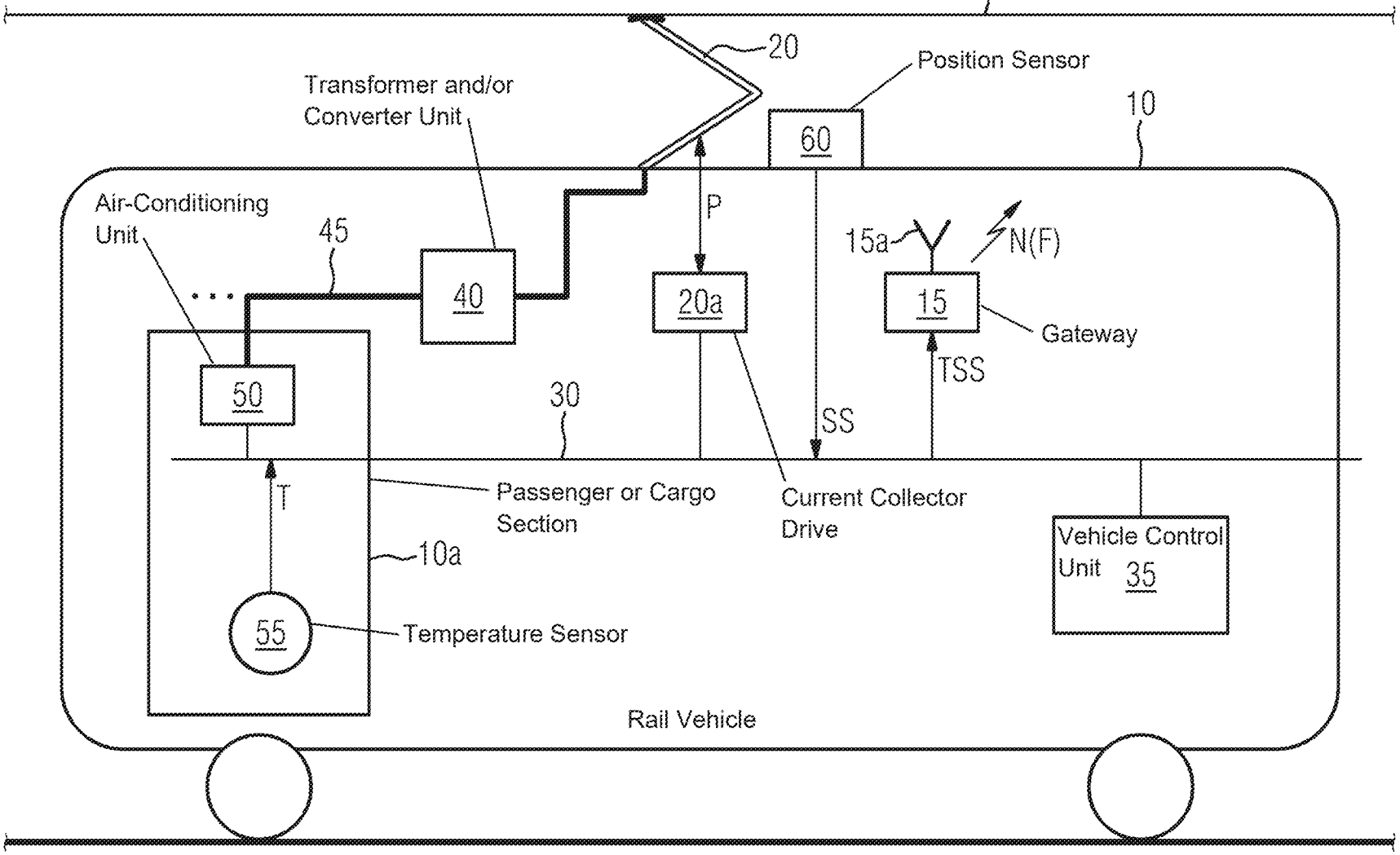
FIG. 5 shows a third exemplary embodiment of a rail vehicle according to the invention in which a position sensor is additionally connected to the data bus.

FIG. 5 shows a third exemplary embodiment of a rail vehicle 10, which is equipped with an exemplary embodiment of a gateway 15 according to the invention.

In the exemplary embodiment according to FIG. 5, a position sensor 60 is additionally connected to the data bus 30 to monitor the position of the current collector 20 and feed a corresponding position signal SS into the data bus 30; since the gateway 15 is connected to the data bus 30, it also able to receive and evaluate this position signal.

The gateway 15 is thus able to detect the position of the current collector 20 directly by means of the position sensor 60. With an appropriate configuration of the gateway 15, in particular with appropriate programming of the operating software of the gateway 15, the gateway 15 is advantageously able to infer a deviation of the status of the current collector 20 from its target status, for example if the detected position of the current collector 20 deviates from the raised position during the train preparation method.

Figure 6:
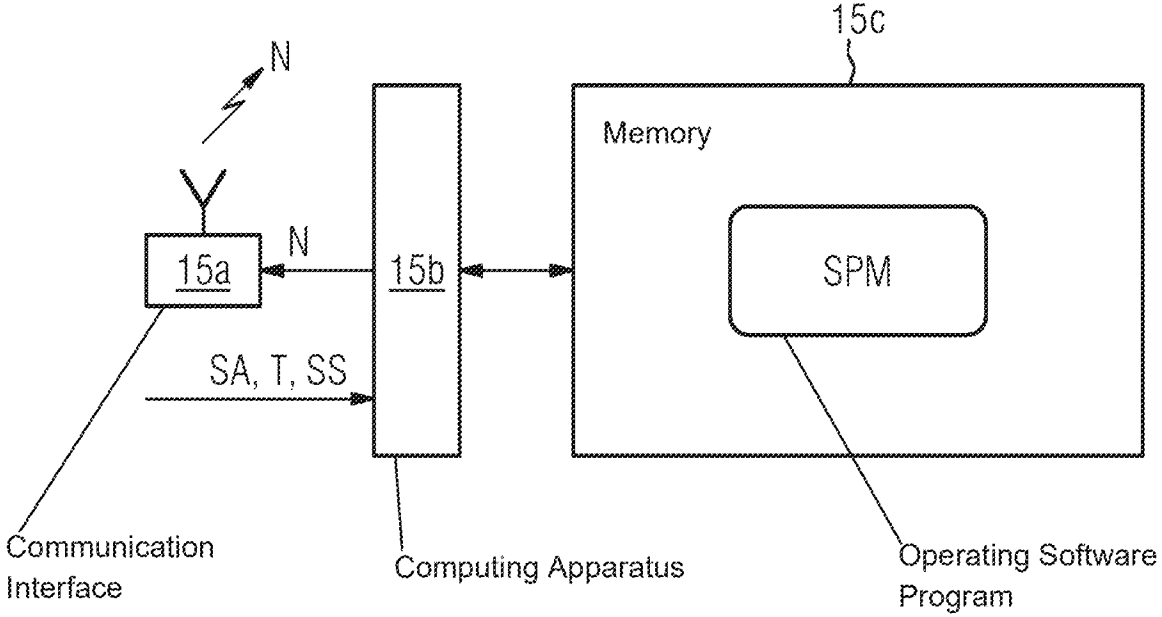
FIG. 6 shows an exemplary embodiment of a gateway according to the invention in more detail.

FIG. 6 shows an exemplary embodiment of a gateway according to the invention 15 which can be used in the rail vehicles according to FIGS. 1 to 5.

The gateway 15 according to FIG. 6 comprises the aforementioned mobile-radio-compatible communication interface 15*a*, which can, for example, be a GSM-compatible mobile radio module.

A computing apparatus 15*b*, which is also connected to the data bus 30 and can communicate and receive data via said data bus, is connected to the mobile-radio-compatible communication interface 15*a*.

The computing apparatus 15*b* is also connected to a memory 15*c* in which an operating software program SPM is stored which, when executed by the computing apparatus 15*b*, enables the gateway 15 to operate as described above in connection with FIGS. 1 to 5.

Finally, it should be mentioned that the features of all the above-described exemplary embodiments can be combined with one another as desired in order to form further embodiments of the invention.

In addition, all the features of the subclaims can in each case be combined with any of the subordinate subclaims and, to be precise, in each case individually or in any combination with one or more other subclaims, in order to obtain further exemplary embodiments.

The invention claimed is:

1. A train preparation method for bringing a stabled and not-yet-operational rail vehicle into an operational state, the method comprising:

carrying out the train preparation in an active position of at least one current collector of the rail vehicle and supplying the rail vehicle with electrical energy by an electrical current flowing through the at least one current collector;

using a gateway to monitor at least one status of at least one component of the rail vehicle, upon the status deviating from a target status specified for train preparation, generating an error signal and, upon the error signal being present, transmitting a message with a gateway-specific mobile-radio-compatible communication interface;

using the at least one current collector as the at least one component or at least one of a plurality of components having the status to be monitored;

monitoring an actuation state of the at least one current collector as the status;

generating the error signal upon the actuation state of the at least one current collector defining a lowering of the at least one current collector; and using or at least including a transmission of a lowering control command causing the at least one current collector to be lowered, in the monitoring of the actuation state of the at least one current collector.

2. The method according to claim 1, which further comprises:

additionally monitoring a position of the at least one current collector as the status; and additionally generating the error signal upon the at least one current collector being lowered.

3. The method according to claim 1, which further comprises:

connecting the gateway to a data bus of the rail-vehicle;

using the gateway to monitor data traffic on the data bus; and using the gateway to monitor the status by evaluating the data traffic.

4. The method according to claim 1, which further comprises using a mobile radio network to send out a message upon the error signal being present, and using the message to report at least one of the current collector lowering or a fault in the train preparation upon the error signal being present.

5. The method according to claim 1, which further comprises using a mobile radio network to send out a message as an SMS, a push message or an email, to another mobile radio terminal or to a trackside control center or a cloud-based control center.

6. The method according to claim 1, which further comprises using an electrical load connected to the current collector as the at least one component or at least one of a plurality of components to be monitored in terms of status.

7. The method according to claim 1, which further comprises:

using a temperature sensor to detect a temperature development within the rail vehicle; and inferring a deviation of the status of the component from the target status upon a measured temperature development deviating from a temperature development specified for the train preparation beyond a specified level.

8. The method according to claim 7, which further comprises using the temperature sensor to monitor the temperature development within a cargo section of the rail vehicle.

9. The method according to claim 1, which further comprises connecting the at least one component or at least one of a plurality of components to be monitored in terms of status to a data bus of the rail vehicle, and determining the status of the component by observing data traffic on the data bus.

10. The method according to claim 9, which further comprises determining the status of the component by observing control commands transmitted over the data bus or measurement signals transmitted over the data bus or signal levels present on the data bus or process data transmitted over the data bus.

11. The method according to claim 9, which further comprises:

carrying out the monitoring of the data bus by monitoring the data bus for a transmission of a lowering control command causing the at least one current collector to be lowered; and upon detection of the lowering control command, communicating a message over a mobile radio network that at least one of a fault in the train preparation has occurred or the lowering control command has been identified.

12. A gateway, comprising:

a facility for monitoring data traffic on a rail vehicle data bus connected to the gateway;

the gateway configured to use the data traffic to monitor a status of at least one component of the rail vehicle and, upon the status deviating from a target status specified for train preparation, to generate an error signal and, upon the error signal being present, to transmit a message with a gateway-specific mobile-radio-compatible communication interface reporting at least one of the error signal or a fault in the train preparation or the status deviation or a status change;

the gateway configured to monitor the data bus during train preparation for a transmission of a lowering control command causing at least one current collector to be lowered; and the gateway configured, upon detection of the lowering control command, to communicate the message that the fault in the train preparation has occurred over a mobile radio network.

13. A rail vehicle, comprising the gateway according to claim 12.

14. The gateway according to claim 12, which further comprises a position sensor for monitoring a position of the at least one current collector as the monitored status, the error signal being generated upon the current collector being lowered.

15. The gateway according to claim 12, wherein the error signal is a fault indication generated upon deviation from a train-preparation target status.

16. The gateway according to claim 12, wherein the gateway is configured, upon detection of the lowering control command, to communicate the message that the lowering control command has been identified over a mobile radio network.

* * * * *